US010813469B2

(12) United States Patent
Turoso et al.

(10) Patent No.: US 10,813,469 B2
(45) Date of Patent: Oct. 27, 2020

(54) COOLING SUPPORT CUSHION AND METHOD OF PRODUCING THE SAME

(71) Applicant: Tempur World, LLC, Lexington, KY (US)

(72) Inventors: Anthony G. Turoso, Louisville, KY (US); Stephen Wallace, Duffield, VA (US); Beat Niederoest, West Berlin, NJ (US); Michael Mozeika, West Berlin, NJ (US)

(73) Assignee: Tempur World, LLC, Lexington, KY (US)

( * ) Notice: Subject to any disclaimer, the term of this patent is extended or adjusted under 35 U.S.C. 154(b) by 187 days.

(21) Appl. No.: 16/066,833

(22) PCT Filed: Dec. 30, 2016

(86) PCT No.: PCT/US2016/069456
§ 371 (c)(1),
(2) Date: Jun. 28, 2018

(87) PCT Pub. No.: WO2017/117515
PCT Pub. Date: Jul. 6, 2017

(65) Prior Publication Data

US 2019/0008285 A1 Jan. 10, 2019

Related U.S. Application Data

(60) Provisional application No. 62/272,952, filed on Dec. 30, 2015.

(51) Int. Cl.
*A47C 21/04* (2006.01)
*A47C 27/14* (2006.01)
(Continued)

(52) U.S. Cl.
CPC ..... *A47C 21/046* (2013.01); *A47C 7/18* (2013.01); *A47C 27/085* (2013.01);
(Continued)

(58) Field of Classification Search
CPC ..... A47C 21/046; A47C 7/18; A47C 27/17; A47C 27/14; A47C 27/15; A47C 27/088;
(Continued)

(56) References Cited

U.S. PATENT DOCUMENTS 5,955,188 A 9/1999 Pushaw
7,793,372 B2 9/2010 Lean et al.
(Continued)

FOREIGN PATENT DOCUMENTS

CN 1649532 A 8/2005
CN 102273843 A 12/2011
(Continued)

OTHER PUBLICATIONS

European Patent Office, Extended European Search Report, Application No. 16882745.9, dated Feb. 21, 2019, 10 pages.
(Continued)

*Primary Examiner* — Robert G Santos
*Assistant Examiner* — Alison N Labarge
(74) *Attorney, Agent, or Firm* — Middleton Reutlinger

(57) ABSTRACT

A support cushion and a method of producing a support cushion are provided. The support cushion includes a base layer having a lower surface and an upper surface, and a plurality of surface coatings positioned atop the upper surface of the base layer, the plurality of surface coatings configured to allow an amount of air to flow through the base layer and the plurality of surface coatings, and the plurality of surface coatings further configured to provide a cooling effect. The method of producing a support cushion includes the steps of providing a base layer having a lower surface
(Continued)

and an upper surface; applying a plurality of surface coatings to the upper surface of the base layer, the plurality of surface coatings configured to allow an amount of air to flow through the base layer and the plurality of surface coatings and further configured to provide a cooling effect.

18 Claims, 2 Drawing Sheets

(51) Int. Cl.

| | |
|---|---|
| ***A47C 7/18*** | (2006.01) |
| ***A47C 27/08*** | (2006.01) |
| ***A47C 27/15*** | (2006.01) |
| ***B05D 7/02*** | (2006.01) |
| ***B68G 7/05*** | (2006.01) |
| ***B05D 1/42*** | (2006.01) |

(52) U.S. Cl.
CPC ..... *A47C 27/088* (2013.01); *A47C 27/14* (2013.01); *A47C 27/15* (2013.01); *B05D 7/02* (2013.01); *B68G 7/05* (2013.01); *B05D 1/42* (2013.01)

(58) Field of Classification Search
CPC ..... A47C 27/085; A47C 21/04; A47C 21/042; B68G 7/05; B05D 1/42; B05D 7/02; A47G 9/1036; A47G 2009/1018
See application file for complete search history.

(56) References Cited

U.S. PATENT DOCUMENTS

| | | | | |
|---|---|---|---|---|
| 8,025,964 | B2 * | 9/2011 | Landvik | A47C 27/15 428/316.6 |
| 2007/0246157 | A1 * | 10/2007 | Mason | A47C 27/085 156/242 |
| 2009/0288259 | A1 | 11/2009 | Lean et al. | |
| 2012/0193572 | A1 | 8/2012 | Mackay | |
| 2012/0227185 | A1 | 9/2012 | Batiste et al. | |
| 2012/0276339 | A1 | 11/2012 | Pearce et al. | |
| 2013/0295371 | A1 | 11/2013 | Peterson et al. | |
| 2014/0039082 | A1 * | 2/2014 | Peterson | A47C 27/15 521/170 |
| 2014/0141233 | A1 | 5/2014 | Crawford et al. | |
| 2015/0067967 | A1 * | 3/2015 | Tyree | A47C 27/144 5/691 |
| 2015/0197610 | A1 | 7/2015 | Peterson et al. | |
| 2015/0296994 | A1 * | 10/2015 | Mikkelsen | A47C 21/046 5/655.4 |
| 2015/0351557 | A1 | 12/2015 | Allen | |
| 2016/0286972 | A1 * | 10/2016 | DeFranks | A47C 27/15 |
| 2017/0020299 | A1 * | 1/2017 | Valenta | A47C 27/002 |

FOREIGN PATENT DOCUMENTS

| | | | | |
|---|---|---|---|---|
| CN | 103960911 | A | 8/2014 | |
| CN | 104135897 | A | 11/2014 | |
| CN | 104768427 | A | 7/2015 | |
| EP | 2801464 | A1 * | 11/2014 | B32B 5/18 |
| EP | 2801464 | A1 | 11/2014 | |
| EP | 3066963 | A1 | 9/2016 | |
| WO | 02102195 | A2 | 12/2002 | |
| WO | 2013112840 | A1 | 8/2013 | |
| WO | 2017117515 | A1 | 7/2017 | |

OTHER PUBLICATIONS

Korean Intellectual Property Office, International Search Report and Written Opinion for PCT/US2016/069456 dated Apr. 20, 2017.
China National Intellectual Property Administration, Notification of First Office Action in App. No. 201680081441.6 dated Apr. 2, 2020 (English Translation included).

* cited by examiner

COOLING SUPPORT CUSHION AND METHOD OF PRODUCING THE SAME

This 371 National Stage Entry Patent Application claims priority to and benefit of, under 35 U.S.C. § 119(e), PCT application number PCT/US2016/069456, filed Dec. 30, 2016, titled, "Cooling Support Cushion and Method of Producing the Same", which is incorporated by reference herein.

RELATED APPLICATIONS

This application claims the benefit of U.S. Provisional Application Ser. No. 62/272,952, filed Dec. 30, 2015, the entire disclosure of which is incorporated herein by this reference.

TECHNICAL FIELD

The present embodiments relate to cooling support cushions and methods of producing the same. In particular, the present embodiments relate to cooling support cushions and methods of producing the same that make use of a plurality of surface coatings to provide an extended cooling effect.

BACKGROUND

The effectiveness and desirability of a support cushion is partly a function of how comfortable a user is on the support cushion over an extended period of time. In this regard, many users find support cushions, and in particular mattresses, which are made of a visco-elastic foam to be uncomfortably warm after an extended period of time. One solution to this problem is the inclusion of phase change materials that absorb heat as they change from a solid to a liquid phase, i.e., melt. These phase change materials, however, typically only cool for a short span of time.

Accordingly, there remains a need in the art for a support cushion that provides an extended cooling experience.

SUMMARY

The present embodiments include cooling support cushions and methods of producing the same. In particular, the present embodiments include cooling support cushions and methods of producing the same that make use of a plurality of surface coatings to provide an extended cooling effect.

In some embodiments, a support cushion is provided that includes a base layer having a lower surface and an upper surface, and a plurality of surface coatings positioned atop the upper surface of the base layer. The plurality of surface coatings are configured to allow an amount of air to flow through the base layer and the plurality of surface coatings, and the plurality of surface coatings are further configured to provide a cooling effect. In one embodiment, the base layer is a flexible foam. In another embodiment, the airflow retained through the lower surface of the base layer is from about 60% to about 80% and the airflow retained through the upper surface of the base layer and the plurality of surface coatings is from about 40% to about 60%. In some embodiments, one or more of the plurality of surface coatings includes an additive that has a thermal conductivity higher than a thermal conductivity of the base layer.

In one embodiment, the plurality of surface coatings comprises two surface coatings. In another embodiment, the plurality of surface coatings comprises up to six surface coatings. Additionally or alternatively, in some embodiments, each of the plurality of surface coatings has a thickness of less than about 5 mm. In one embodiment, the plurality of surface coatings collectively have a thickness of less than about 5 mm.

In one embodiment, one or more of the plurality of surface coatings comprises isocyanate and a polyol. In another embodiment, one or more of the plurality of surface coatings includes an amount of phase change material. In a further embodiment, the phase change material is configured to undergo a phase change at a temperature of about 20° C. to about 36° C.

In some embodiments, a method of producing a support cushion includes the steps of providing a base layer having a lower surface and an upper surface; applying a plurality of surface coatings to the upper surface of the base layer, the plurality of surface coatings configured to allow an amount of air to flow through the base layer and the plurality of surface coatings and further configured to provide a cooling effect. In one embodiment, the step of applying a plurality of surface coatings comprises applying three surface coatings. In another embodiment, the step of applying a plurality of surface coatings comprises applying up to six surface coatings. In a further embodiment, the method also includes the steps of applying a liquid precursor to the upper surface of the base layer; and curing the liquid precursor to form one of the plurality of surface coatings on the upper surface of the base layer. In certain embodiments, the method further includes the step of combining isocyanate and polyol to form the liquid precursor. In some embodiments, one or more of the plurality of surface coatings includes an amount of phase change material.

In some embodiments, a method of producing a support cushion is provided that includes the steps of providing a base layer having a lower surface and an upper surface; applying a first surface coating to the upper surface of the base layer, with the first surface coating including an amount of phase change material; applying a second surface coating atop the first surface coating, with the second surface coating including an isocyanate and a polyol; and applying a third surface coating atop the second surface coating, with the third surface coating also including an amount of phase change material.

Further features and advantages of the present invention will become evident to those of ordinary skill in the art after a study of the description, figures, and non-limiting examples in this document.

DESCRIPTION OF EXEMPLARY EMBODIMENTS

Figure 1:
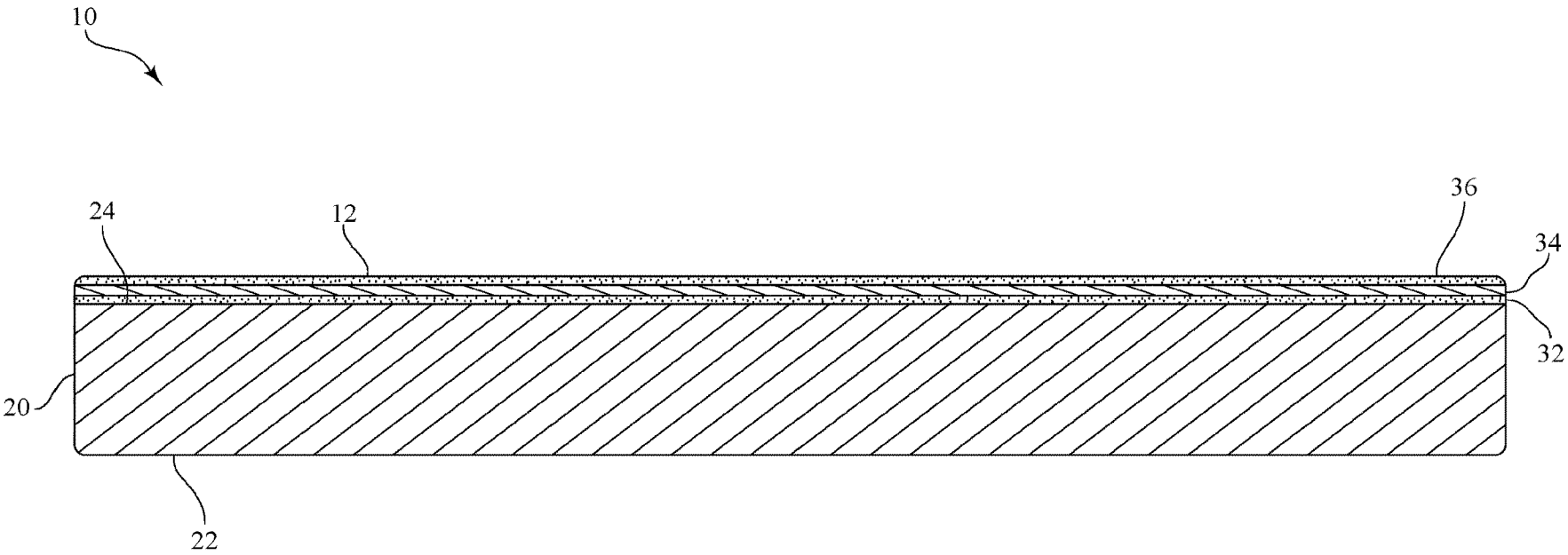
FIG. 1 is a side view of a support cushion in the form of a mattress and made in accordance with the present invention.

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

Unless defined otherwise, all technical and scientific terms used herein have the same meaning as is commonly understood by one of skill in the art to which the invention(s) belong. All patents, patent applications, published applications and publications, databases, websites and other published materials referred to throughout the entire disclosure herein, unless noted otherwise, are incorporated by reference in their entirety. In the event that there are a plurality of definitions for terms herein, those in this section prevail. Where reference is made to a URL or other such identifier or address, it understood that such identifiers can change and particular information on the internet can come and go, but equivalent information can be found by searching the internet. Reference thereto evidences the availability and public dissemination of such information.

Although any methods, devices, and materials similar or equivalent to those described herein can be used in the practice or testing of the presently-disclosed subject matter, representative methods, devices, and materials are now described.

Following long-standing patent law convention, the terms "a", "an", and "the" refer to "one or more" when used in this application, including the claims. Thus, for example, reference to "a layer" includes a plurality of such layers, and so forth.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

The present invention includes cooling support cushions and methods of producing the same. In particular, the present invention includes cooling support cushions and methods of producing the same that make use of a plurality of surface coatings to provide an extended cooling effect.

Referring first to FIG. 1, in one exemplary embodiment of the present invention, a support cushion 10 in the form of a mattress and having a support surface 12 is provided. The support cushion 10 includes a base layer 20 having a lower surface 22 and an upper surface 24. The support cushion 10 also includes a plurality of surface coatings 32, 34, 36 that are sequentially applied to the base layer 20 to collectively provide a cooling effect at the support surface 12 of the support cushion 10 and that are configured to allow air to flow through both the plurality of surface coatings 32, 34, 36 and the base layer 20.

The base layer 20 of the support cushion is generally comprised of a flexible foam that is capable of suitably distributing pressure from a user's body or portion thereof across the support cushion 10. Various flexible foams can be used in this regard including, but not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like, but in any case, the flexible foam used in the base layer 20 of the support cushion 10 is porous and typically allows an amount of air to flow through the base layer of the support cushion 10.

In some exemplary embodiments, the flexible foam comprising the base layer 20 is comprised of a visco-elastic polyurethane foam having a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 24 39 hardness measuring standard. In some embodiments, the visco-elastic foam comprising the base layer 20 has a hardness of about 10 N, about 20 N, about 30 N, about 40 N, about 50 N, about 60 N, about 70 N, or about 80 N to provide a desired degree of comfort and body-conforming qualities.

The visco-elastic foam described herein for use in the base layer 20 of the support cushion 10 can also have a density that assists in providing a desired degree of comfort and body-conforming qualities, as well as an increased degree of material durability. In some embodiments, the density of the visco-elastic foam used in the base layer 20 has a density of no less than about 30 $kg/m^3$ to no greater than about 150 $kg/m^3$. In some embodiments, the density of the visco-elastic foam used in the base layer of the support cushion is about 30 $kg/m^3$, about 40 $kg/m^3$, about 50 $kg/m^3$, about 60 $kg/m^3$, about 70 $kg/m^3$, about 80 $kg/m^3$, about 90 $kg/m^3$, about 100 $kg/m^3$, about 110 $kg/m^3$, about 120 $kg/m^3$, about 130 $kg/m^3$, about 140 $kg/m^3$, or about 150 $kg/m^3$. Of course, the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for an exemplary support cushion or for a particular application as desired. Moreover, although the base layer 20 of the support cushion 10 shown in FIG. 1 is shown as being comprised of a single layer of foam, it is further appreciated that a base layer of an exemplary support cushion of the present invention can be comprised of multiple layers of foam having varying or the same densities or hardness values.

Regardless of the particular density and hardness values of a base layer 20, and turning now to the plurality of surface coatings 32, 34, 36 applied to the upper surface 24 of the base layer 20, each of the surface coatings 32, 34, 36 is typically applied individually to the base layer 20 as a liquid or liquid precursor which then dries or cures to form the respective surface coating. Specifically, in the exemplary embodiment shown in FIG. 1, a first surface coating 32 is directly applied to the upper surface 24 of the base layer 20, a second surface coating 34 is then applied to the first surface coating 32, and a third surface coating 36 is then applied to the second surface coating 34.

As mentioned above, each the plurality of surface coatings 32, 34, 36 are configured to allow air to flow through the plurality of surface coatings 32, 34, 36 and the base layer 20 (as illustrated in FIG. 1). In this regard, when applying each of the plurality of surface coatings 32, 34, 36 to the base layer 20, it is generally the case that the cell structure of the base layer 20 will remain visible on the surface of the base layer 20 (i.e., each of the surface coatings will not completely cover the cell structure of the underlying foam), such that airflow through the base layer 20 and through the plurality of surface coatings 32, 34, 36 can be maintained in order to maintain and/or improve heat transfer away from the upper surface 24 of the base layer 20 and provide a cooling effect at the support surface 12 of the support cushion 10.

In some embodiments, one or more of the plurality of surface coatings 32, 34, 36 applied to the base layer 20 also includes an amount of phase change material. In one embodiment, the phase change material improves and/or increases the cooling effect of the plurality of surface coatings 32, 34, 36. In another embodiment, the phase change material is included in any suitable amount and/or in any suitable surface coating 32, 34, 36 or combination of surface coatings 32, 34, 36. For example, in the exemplary embodiment shown in FIG. 1, an amount of phase change material is included in both the first surface coating 32 and the third surface coating 36 with no phase change material included in the second surface coating 34. Of course, it is contemplated that, depending on the number of surface coatings applied to an exemplary support cushion, various other combinations of layers including or not including various amounts of phase change material can also be produced without departing from the spirit and scope of the present invention.

With further regard to the phase change material, in some embodiments, the phase change material utilized in the surface coatings is a phase change material (PCM) slurry manufactured and sold by Microtek Laboratories, Inc. (Dayton, Ohio). Other exemplary phase change materials that can be utilized include a PCM slurry or a PCM cake manufactured and sold by Encapsys, LLC (Appleton, Wis.). In some embodiments, the phase change material used in the support cushions of the present invention undergoes its phase change at a temperature of about 20° C. to about 36° C. Of course, other phase change materials can also be used in the surface coatings of the present invention to provide an amount of cooling and can be configured to undergo a phase change at alternative temperature ranges depending on the particular intended use of the support cushion. In some embodiments, however, to further improve the cooling effect, one or more of the plurality of surface coatings can also include additional additives that have a higher thermal conductivity than the base layer 20.

As noted above, in the exemplary embodiment shown in FIG. 1, no phase change material is included in the second surface coating 34, while an amount of phase change material is included in both the first surface coating 32 and the third surface coating 36. In particular, in the exemplary embodiment shown in FIG. 1, the second surface coating 34 is formed from a liquid precursor that includes isocyanate and polyol. In this regard, in at least some embodiments of the present invention, the liquid precursor that forms at least one of the surface coatings includes two or more components that, when combined, react to polymerize and cure the liquid precursor to form the final surface coating. For example, in some embodiments, such as the exemplary embodiment depicted in FIG. 1, the liquid precursor includes isocyanate and a polyol that are combined immediately before being applied and that cure upon application to the support cushion 10.

In certain embodiments, the particular components included in each of the individual surface coatings as well as the particular ratios of each component can vary depending on the desired properties of the resulting surface coating. Furthermore, each surface coating can be comprised of a unique combination of components and/or ratios without departing from the spirit and scope of the present invention. Several exemplary surface coatings and PCM formulations are described in Tables 1 to 4. In the examples in Tables 1 and 2, which describe multiple formulations of liquid precursors, a first surface coating is applied directly onto the upper surface of the base layer (i.e., "PCM Mixture 1st Spray" in Table 1), a second surface coating is applied on top of the first surface coating (i.e., "Gel Mixture" in Table 1), and a third surface coating is applied on top of the second surface coating (i.e., "PCM Mixture 2nd Spray" in Table 1), but these examples should not be considered limiting.

As also illustrated in Tables 1 and 2, the initial airflow through the base layer is, in all cases, about 70% of the original airflow applied to the base layer. After applying the three surface coatings, the airflow through the lower surface of the base layer decreases negligibly to a range of about 65% to about 70%. Although the airflow through the upper surface of the base layer and the plurality of surface coatings shows a more substantial decrease to a range of about 45% to about 57%, a significant portion of the original airflow is still maintained. In some embodiments, the airflow through the lower surface of the base layer is from about 60% to about 80% and the airflow through the upper surface of the base layer and the plurality of surface coatings is from about 40% to about 65%. In some embodiments, about 65% of the airflow observed in base layer prior to application of the surface coatings is retained after application of the surface coating in accordance with the methods of the present invention.

TABLE 1

Ariel Gel Sprayed Samples

| Sample Number | PCM Mixture 1st Spray | PCM Mixture 2nd Spray | Gel Mixture | Sample Size (Sq/ft) | Initial Weight (gms) | Spray Weight after 1st Layer (gms) | Liquid Pickup (1st Layer) | Gel Spray Weight (gms) | Gel On Sample (gms) | 2nd PCM Spray Weight (gms) |
|---|---|---|---|---|---|---|---|---|---|---|
| 1 | Microtek Slurry 23% | Microtek Slurry 23% | 80/20 Blend | 0.78 | 205.8 | 244.6 | 38.8 | 335.7 | 91.1 | 388.6 |
| 2 | Microtek Slurry | Microtek Slurry | 80/20 Blend | 0.78 | 214.7 | 249.1 | 34.4 | 342.7 | 93.6 | 396.5 |

TABLE 1-continued

Ariel Gel Sprayed Samples

| | | | | | | | | | | |
|---|---|---|---|---|---|---|---|---|---|---|
| | 23%/2% Binder | 23%/2% Binder | | | | | | | | |
| 3 | Microtek Slurry 23% | Microtek Slurry 23% | 80/20 Blend | 1.83 | 294.8 | 397.9 | 103.1 | 516.4 | 118.5 | 667.7 |
| 4 | Water | Encapsys Cake and Water | 80/20 Blend | 0.78 | 191.1 | 252.2 | 61.1 | 399.7 | 147.5 | 494.3 |
| 5 | Microtek Slurry 23% 70% 28D - 30% 37D | Microtek Slurry 23% 70% 28D - 30% 37D | 80/20 Blend | 0.78 | 194 | 263.4 | 69.4 | 536.2 | 272.8 | 598 |
| 6 | Encapsys Slurry 23% | Encapsys Slurry 23% | 80/20 Blend | 1.83 | 321.9 | 499.29 | 177.39 | 610.28 | 110.99 | 884.3 |
| 7 | Encapsys Slurry 23% | Encapsys Slurry 23% | 80/20 Blend | 1.83 | 272.5 | 375.68 | 103.18 | 479.69 | 104.01 | 523.1 |
| 8 | Encapsys Slurry 23% | Encapsys Slurry 23% | 80/20 Blend | 1.83 | 292 | 412.06 | 120.06 | 538.78 | 126.72 | 672.1 |
| 9 | Encapsys Slurry 23% | Encapsys Slurry 23% | 80/20 Blend | 1.83 | 280.1 | 454.49 | 174.39 | 566.25 | 111.76 | 715.1 |
| 10 | Encapsys Slurry 23% | Encapsys Slurry 23% | 80/20 Blend | 1.83 | 270.1 | 408.06 | 137.96 | 523.34 | 115.28 | 692.3 |
| 11 | Encapsys Slurry 23% | Encapsys Slurry 23% | 80/20 Blend | 1.83 | 269.3 | 388.99 | 119.69 | 509.28 | 120.29 | 643.6 |
| 12 | Encapsys Slurry/ Microtek - 23% | Encapsys Slurry/ Microtek - 23% | 80/20 Blend | 1.83 | 305.9 | 406.35 | 100.45 | 541.61 | 135.26 | 646.7 |
| 13 | Encapsys Slurry/ Microtek - 23% | Encapsys Slurry/ Microtek - 23% | 80/20 Blend | 1.83 | 274.6 | 398.58 | 123.98 | 528.43 | 129.85 | 650.8 |
| 14 | Encapsys Slurry/ Microtek - 23% | Encapsys Slurry/ Microtek - 23% | 80/20 Blend | 1.83 | 301.2 | 437.26 | 136.06 | 572.19 | 134.93 | 762.2 |
| 15 | Microtek 37D 23% | Microtek 37D 23% | 80/20 Blend | 1.83 | 287.3 | 488.81 | 201.51 | 616.84 | 128.03 | 688.7 |
| 16 | Microtek 37D 23% | Microtek 37D 23% | 80/20 Blend | 1.83 | 301.8 | 417.24 | 115.44 | 548.19 | 130.95 | 677.1 |

| Sample Number | Liquid Pickup ($3^{rd}$ layer) (gms) | $1^{st}$ PCM Spray (Wet) gm/Sqft | Dry (23%) | Gel gm/Sqft | $2^{nd}$ PCM Spray (Wet) gm/Sqft | Dry (23%) | Dry Weight (gms) | Airflow Top | Airflow Bottom | Comments |
|---|---|---|---|---|---|---|---|---|---|---|
| 1 | 52.9 | 49.7 | 11.4 | 116.8 | 67.82 | 15.60 | 321 | | | |
| 2 | 53.8 | 44.1 | 10.1 | 120.0 | 68.97 | 15.86 | 332.6 | | | |
| 3 | 151.3 | 56.3 | 13.0 | 64.8 | 82.68 | | | | | Control Samples |
| 4 | 94.6 | 78.3 | 18.0 | 189.1 | 121.28 | 27.89 | | | | Too Heavy and low air flow second coat was blowing off foam when Air knifed |
| 5 | 61.8 | 89.0 | 20.5 | 349.7 | 79.23 | 18.22 | | | | Too Heavy and low air flow second coat was blowing off foam when Air knifed |
| 6 | 274.02 | 96.9 | 22.3 | 60.7 | 149.74 | 34.44 | 623.4 | 50 | 69 | Crusty Surface when Dry |
| 7 | 43.41 | 56.4 | 13.0 | 56.8 | 23.72 | 5.46 | 452.19 | 57 | 69 | Crusty Surface when Dry |
| 8 | 133.32 | 65.6 | 15.1 | 69.2 | 72.85 | 16.76 | 548.91 | 47 | 69 | Crusty Surface when Dry |
| 9 | 148.85 | 95.3 | 21.9 | 61.1 | 81.34 | 18.71 | 567.42 | 50 | 69 | Crusty Surface when Dry |
| 10 | 168.96 | 75.4 | 17.3 | 63.0 | 92.33 | 21.24 | 535.86 | 48 | 68 | Crusty Surface when Dry |
| 11 | 134.32 | 65.4 | 15.0 | 65.7 | 73.40 | 16.88 | 595.12 | 48 | 70 | Crusty Surface when Dry |
| 12 | 105.09 | 54.9 | 12.6 | 73.9 | 57.43 | 13.21 | 546.58 | 47 | 68 | Crusty Surface when Dry |
| 13 | 122.37 | 67.7 | 15.6 | 71.0 | 66.87 | 15.38 | 518.21 | 50 | 70 | Crusty Surface when Dry |
| 14 | 190.01 | 74.3 | 17.1 | 73.7 | 103.83 | 23.88 | 578.53 | 48 | 68 | Crusty Surface when Dry |

TABLE 1-continued

| Ariel Gel Sprayed Samples | | | | | | | | | | |
|---|---|---|---|---|---|---|---|---|---|---|
| 15 | 71.86 | 110.1 | 25.3 | 70.0 | 39.27 | 9.03 | 483.77 | 48 | 66 | Foam feels nicer like the Control by 37D PCM does not have the same feel as the 28D |
| 16 | 128.91 | 63.1 | 14.5 | 71.6 | 70.44 | 16.20 | 493.08 | 50 | 70 | Foam feels nicer like the Control by 37D PCM does not have the same feel as the 28D |

TABLE 2

| Sample | PCM Mix | Airflow Initial | Airflow Top/DRY | Airflow Bottom/DRY | Density Initial | Initial Weight | PCM Spray | PCM Spray Weight |
|---|---|---|---|---|---|---|---|---|
| 1 | MT/SI/23% | | | | 2.13 | 205.80 | 244.6 | 38.80 |
| 2 | MT/SI/23%/82% | | | | 2.77 | 214.70 | 249.1 | 34.40 |
| 3 | MT/SI/23% | | | | 2.77 | 294.80 | 397.9 | 103.10 |
| 4 | W/EN/C | | | | 2.77 | 191.10 | 252.2 | 61.10 |
| 5 | MT/SI/23%(28/37) | | | | 2.77 | 194.00 | 263.4 | 69.40 |
| 6 | ENCapsys 23% | 70 | 50 | 69 | 2.77 | 321.90 | 499.29 | 177.39 |
| 7 | ENCapsys 23% | 70 | 57 | 69 | 2.77 | 272.50 | 375.68 | 103.18 |
| 8 | ENCapsys 23% | 70 | 47 | 69 | 2.77 | 292.00 | 412.06 | 120.06 |
| 9 | ENCapsys 23% | 70 | 50 | 69 | 2.77 | 280.10 | 454.49 | 174.39 |
| 10 | ENCapsys 23% | 70 | 48 | 68 | 2.77 | 270.10 | 408.06 | 137.96 |
| 11 | ENCapsys 23% | 70 | 48 | 70 | 2.77 | 269.30 | 388.99 | 119.69 |
| 12 | EN sl/Micro | 70 | 47 | 68 | 2.77 | 305.90 | 406.35 | 100.45 |
| 13 | EN sl/Micro | 70 | 50 | 70 | 2.77 | 274.60 | 398.58 | 123.98 |
| 14 | EN sl/Micro | 70 | 45 | 68 | 2.77 | 301.20 | 437.26 | 136.06 |
| 15 | Micro37D/23% | 70 | 48 | 65 | 2.77 | 287.30 | 488.81 | 201.51 |
| 16 | Micro37D/23% | 70 | 55 | 70 | 2.77 | 301.80 | 417.24 | 115.44 |

| Sample | Gel Spray | Gel Spray Weight | PCM Spray | PCM Spray Weight | 1st PCM wt. sq/in | Gel wt. sq/in | 2nd PCM wt sq/in | Dry Weight | Moisture % Loss |
|---|---|---|---|---|---|---|---|---|---|
| 1 | 335.7 | 91.1 | 388.6 | 52.9 | 0.34 | 0.81 | 0.47 | 321 | 13.6% |
| 2 | 342.7 | 93.6 | 396.5 | 53.8 | 0.31 | 0.83 | 0.48 | 332.6 | 13.6% |
| 3 | 516.4 | 118.5 | 667.7 | 151.3 | 0.39 | 0.45 | 0.57 | | 22.7% |
| 4 | 399.7 | 147.5 | 494.3 | 94.6 | 0.23 | 0.56 | 0.36 | | 19.1% |
| 5 | 536.2 | 272.8 | 598.0 | 61.8 | 0.26 | 1.03 | 0.23 | | 10.3% |
| 6 | 610.28 | 110.99 | 884.3 | 274.02 | 0.67 | 0.42 | 1.04 | 623.4 | 31.0% |
| 7 | 479.69 | 104.01 | 523.1 | 43.43 | 0.39 | 0.39 | 0.16 | 452.19 | 8.3% |
| 8 | 538.78 | 126.72 | 672.1 | 133.3 | 0.45 | 0.48 | 0.50 | 548.19 | 19.8% |
| 9 | 566.25 | 111.76 | 715.1 | 148.89 | 0.66 | 0.42 | 0.56 | 567.42 | 20.8% |
| 10 | 523.34 | 115.28 | 692.3 | 168.92 | 0.52 | 0.44 | 0.64 | 535.86 | 24.4% |
| 11 | 509.28 | 120.29 | 643.6 | 134.31 | 0.45 | 0.46 | 0.51 | 595.12 | 20.9% |
| 12 | 541.61 | 135.26 | 646.7 | 105.1 | 0.38 | 0.51 | 0.40 | 546.58 | 16.3% |
| 13 | 528.43 | 129.85 | 650.8 | 122.41 | 0.47 | 0.49 | 0.46 | 518.21 | 18.8% |
| 14 | 572.19 | 134.93 | 762.2 | 189.99 | 0.52 | 0.51 | 0.72 | 578.53 | 24.9% |
| 15 | 616.84 | 128.03 | 688.7 | 71.87 | 0.76 | 0.48 | 0.27 | 483.77 | 10.4% |
| 16 | 548.19 | 130.95 | 677.1 | 128.86 | 0.44 | 0.50 | 0.49 | 493.08 | 19.0% |

TABLE 3

| PCM Batch | Grams |
|---|---|
| Water | 4400 |
| Microtek 40 - 23% | 1012 |
| Total | 5412 |

TABLE 4

| PCM Batch | Grams |
|---|---|
| Water | 4000 |
| Microtek 40 - 23% | 1000 |
| Total | 5000 |

Although FIG. 1 and the examples provided in Tables 1 and 2 all contain three surface coating layers, it is further contemplated that, in some embodiments, the plurality of surface coatings include only two coatings while, in other embodiments, the plurality of surface coatings include up to six coatings. For example, in one embodiment, a sample spray method includes thoroughly mixing PCM before spraying, and calibrating PCM spray to determine the length of time to spray on sample plus adding an overspray allowance. This is applicable for each coat of PCM. The gel is sprayed through the popcorn spray gun and the desired weight to be applied to the sample is determined. Then the calculated amount of overspray is added. The two-part batch is made and the entire pre-mix is sprayed on the sample. Once dry, the sample is weighed to get a final weight of the gel and PCM. In another embodiment, gel processing includes: Step 1) spray PCM solid 28 C PCM with binder (30 seconds); Step 2) air knife; Step 3) Gel—1452 gram polyol side and 363 gram prepolymer side each with two sprayers; Step 4) spray PCM solids 28 c PCM with binder (30 seconds); Step 5) air knife.

In any event, each of the plurality of surface coatings is formed with a thickness of less than 5 mm and the plurality of surface coatings collectively are typically less than 5 mm thick. In this regard, the plurality of surface coatings used in accordance with the present invention increase the thermal mass of the support cushion, and the application of multiple layers of the surface coating (with each layer still allowing airflow through the surface coatings) also increases the total amount of phase change material that can be effectively used in the support cushion. Both of these characteristics provide higher thermal effusivity of the support cushion, which, in turn, can provide for a longer lasting cooling effect in a variety of different types and configurations of support cushions. In some embodiments of the present invention, the application of phase change material can be increased from about 20 to about 200 grams/square foot, and the thermal mass can also be increased by increasing the amount of the reactive gel layer (which is typically in the range of 20 to 80 grams/square foot). Both increases provide a higher thermal effusivity which allows for a cooler feeling longer at the point of contact between the user and the various support cushions.

With respect to the support cushions of the present invention, it is contemplated that the support cushions described above can be in the form of pillows, mattresses, seat cushions, seat backs, neck pillows, leg spacer pillows, mattress toppers, overlays, and the like. As such, the phrase "support cushion" is used herein to refer to any and all such objects having any size and shape, and that are capable of or are generally used to support the body of a user or a portion thereof.

Figure 2:
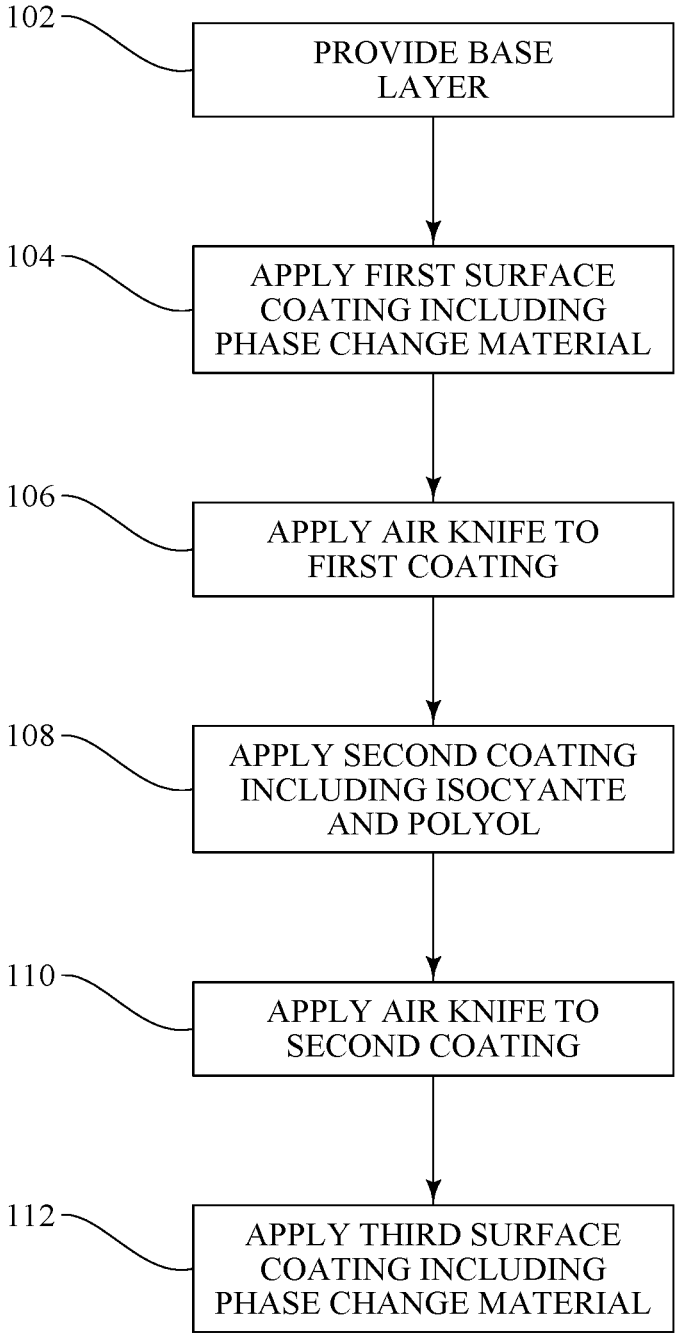
FIG. 2 is a flowchart showing an exemplary implementation of a method of producing a support cushion in accordance with the present invention.

Regardless of the particular form of the support cushion of the present invention, each of the exemplary support cushions described herein can also be produced by an exemplary implementation of a method for producing a support cushion in accordance with the present invention. Referring now to FIG. 2, in one exemplary implementation of a method for producing a support cushion, like the support cushion 10 described above, a base layer of foam is first provided, as indicated by step 102. As described above, the base layer typically has a lower surface and an upper surface and is comprised of a material that is porous and allows air to flow through the base layer.

Referring still to FIG. 2, upon providing the base layer, a first surface coating comprised of a liquid including an amount of phase change material is then applied to the upper surface of the base layer, as indicated by step 104. After dispensing the liquid including the amount of phase change material onto the upper surface of the base layer, an air knife is applied to the first coating, as indicated by step 106. As would be recognized by one skilled in the art, an air knife provides a laminar flow of pressurized air that is drawn across the coating to remove excess material. Furthermore, in at least some embodiments, instead of or in addition to removing excess precursor, the air knife can also be used to drive at least a portion of the liquid precursor into the base layer itself. Of course, in some implementations, the liquid precursor can also be dispensed in such a way that the air knife is not necessary at all.

In any event, and referring still to FIG. 2, once the air knife has been applied to the first coating and the first coating has formed on the base layer, the second coating is then applied atop the first coating in the form of a liquid precursor including an isocyante and a polyol, as indicated by step 108, and is then generally allowed to cure and form the resultant second surface coating. In this regard, in some implementations, the liquid precursor is only allowed to partially cure prior to air knifing the liquid precursor, for example, for about 30 seconds, such that the air knife removes only the portion of the liquid precursor that has not yet cured.

After the liquid precursor forming the second surface coating has reacted for an appropriate amount of time and the resultant second surface coating has formed, a third surface coating, which is also comprised of a liquid including an amount of phase change material, is then applied atop the second surface coating, as indicated by step 112, to thus produce a support cushion that includes a plurality of surface coatings and that provides a cooling effect to a user resting on the support cushion.

Throughout this document, various references may be mentioned. All such references are incorporated herein by reference, including the references set forth in the following list:

REFERENCES

1. U.S. Patent Application Publication No. 2013/295371.
2. European Patent No. 2801464.
3. U.S. Patent Application Publication No. 2012/0276339.
4. U.S. Patent Application Publication No. 2012/0193572.
5. U.S. Pat. No. 7,793,372.
6. U.S. Pat. No. 5,955,188.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A support cushion, comprising:

a base layer having a lower surface and an upper surface; and a plurality of surface coatings positioned atop the upper surface of the base layer, the plurality of surface coatings configured to allow an amount of air to flow through the base layer and the plurality of surface coatings, and the plurality of surface coatings further configured to provide a cooling effect;

wherein said plurality of surface coatings comprises a first phase change layer on said upper surface of the base layer, a second reactive gel layer on said first phase change layer and a third phase change layer on said second reactive gel layer.

2. The support cushion of claim 1, wherein the base layer is a flexible foam.

3. The support cushion of claim 1, wherein the airflow retained through the lower surface of the base layer is from about 60% to about 80% and the airflow retained through the upper surface of the base layer and the plurality of surface coatings is from about 40% to about 60%.

4. The support cushion of claim 1, wherein the plurality of surface coatings comprises three to six surface coatings.

5. The support cushion of claim 1, wherein each of the plurality of surface coatings has a thickness of less than about 5 mm.

6. The support cushion of claim 1, wherein the plurality of surface coatings collectively have a thickness of less than about 5 mm.

7. The support cushion of claim 1, wherein one or more of the plurality of surface coatings comprises isocyanate and a polyol.

8. The support cushion of claim 1, wherein two or more of the plurality of surface coatings includes an amount of phase change material.

9. The support cushion of claim 1, wherein the phase change material is configured to undergo a phase change at a temperature of about 20° C. to about 36° C.

10. The support cushion of claim 1, wherein one or more of the plurality of surface coatings includes an additive that has a thermal conductivity higher than a thermal conductivity of the base layer.

11. A method of producing a support cushion, comprising the steps of:

providing a base layer having a lower surface and an upper surface;

applying a plurality of surface coatings to the upper surface of the base layer, the plurality of surface coatings configured to allow an amount of air to flow through the base layer and the plurality of surface coatings and further configured to provide a cooling effect;

wherein said applying said plurality of surface coatings comprises applying a first phase change layer on said upper surface of the base layer, applying a second reactive gel layer on said first phase change layer and applying a third phase change layer on said second reactive gel layer.

12. The method of claim 11, wherein the step of applying a plurality of surface coatings comprises applying up to six surface coatings.

13. The method of claim 11, further comprising the steps of:

applying a liquid precursor to the upper surface of the base layer; and curing the liquid precursor to form one of the plurality of surface coatings on the upper surface of the base layer.

14. The method of claim 13, further comprising the step of combining isocyanate and polyol to form the liquid precursor.

15. The method of claim 11, wherein the base layer is a flexible foam.

16. The method of claim 11, wherein the airflow retained through the lower surface of the base layer is from about 60% to about 80% and the airflow through the upper surface of the base layer and the plurality of surface coatings is from about 40% to about 60%.

17. The method of claim 11, wherein two or more of the plurality of surface coatings includes an amount of phase change material.

18. A method of producing a support cushion, comprising the steps of:

providing a base layer having a lower surface and an upper surface;

applying a first surface coating to the upper surface of the base layer, the first surface coating including an amount of phase change material;

applying a second surface coating atop the first surface coating, the second surface coating including an isocyanate and a polyol; and applying a third surface coating atop the second surface coating, the third surface coating also including an amount of phase change material.

* * * * *